US009838768B2

(12) United States Patent
Matsui et al.

(10) Patent No.: US 9,838,768 B2
(45) Date of Patent: Dec. 5, 2017

(54) MICROPHONE DEVICE

(71) Applicants: Noriko Matsui, Tokyo (JP); Hiroshi Akino, Tokyo (JP)

(72) Inventors: Noriko Matsui, Tokyo (JP); Hiroshi Akino, Tokyo (JP)

(73) Assignee: KABUSHIKI KAISHA AUDIO TECHNICA, Tokyo (JP)

( * ) Notice: Subject to any disclaimer, the term of this patent is extended or adjusted under 35 U.S.C. 154(b) by 0 days.

(21) Appl. No.: 14/867,603

(22) Filed: Sep. 28, 2015

(65) Prior Publication Data

US 2016/0119702 A1 Apr. 28, 2016

(30) Foreign Application Priority Data

Oct. 27, 2014 (JP) ..... 2014-218171

(51) Int. Cl.

| | |
|---|---|
| ***H04R 21/02*** | (2006.01) |
| ***H04R 1/08*** | (2006.01) |
| *H04R 1/04* | (2006.01) |
| *H04R 1/06* | (2006.01) |
| *H04R 19/04* | (2006.01) |

(52) U.S. Cl.

CPC ..... *H04R 1/083* (2013.01); *H04R 1/04* (2013.01); *H04R 1/06* (2013.01); *H04R 19/04* (2013.01); *H04R 2410/03* (2013.01)

(58) Field of Classification Search

CPC ..... H04R 3/007; H04R 2410/03; H01B 11/1066; H01B 11/06; H01B 11/1058

USPC ..... 381/363

See application file for complete search history.

(56) References Cited

U.S. PATENT DOCUMENTS

| | | | | |
|---|---|---|---|---|
| 4,426,636 | A * | 1/1984 | Ohta | H01B 1/24 29/613 |
| 5,208,426 | A * | 5/1993 | Kennedy | H01B 11/1066 174/102 SC |
| 5,548,082 | A * | 8/1996 | Palmer | H01B 11/1091 174/34 |
| 7,526,097 | B2 * | 4/2009 | Akino | H04R 1/08 381/189 |
| 8,150,088 | B2 * | 4/2012 | Akino | H04R 1/04 381/189 |
| 8,488,830 | B2 * | 7/2013 | Yoshino | H04R 1/086 381/189 |
| 8,520,879 | B2 * | 8/2013 | Yoshino | H04R 1/086 381/361 |
| 8,735,725 | B2 * | 5/2014 | Li | H01B 1/24 174/107 |
| 2011/0048764 | A1 * | 3/2011 | Hira | H01B 11/10 174/105 R |

FOREIGN PATENT DOCUMENTS

| | | | | |
|---|---|---|---|---|
| FR | 2983626 | A1 * | 6/2013 | H01B 11/1066 |
| JP | 2006-33216 | A | 2/2006 | |

* cited by examiner

*Primary Examiner* — Curtis Kuntz
*Assistant Examiner* — Ryan Robinson
(74) *Attorney, Agent, or Firm* — Whitham, Curtis, & Cook

(57) ABSTRACT

The microphone device includes a tubular support of a conductive material. A microphone unit is provided at one end of the support and grounded to the support. A cable passes through the support and includes core wires connected to a signal output terminal of the microphone unit. A conductive covering material that covers the core wires and is electrically connected to the support.

8 Claims, 12 Drawing Sheets

MICROPHONE DEVICE

TECHNICAL FIELD

The present invention relates to a microphone device.

BACKGROUND ART

A typical microphone device is known which has a microphone unit distanced from the base, specifically, has a microphone unit at the tip of the rod support on the base. Examples of such a microphone device include headset microphones and goose-neck microphones.

A headset microphone has a flexible support pipe with a cable passing therethrough for electrical connection to the microphone unit. The flexible pipe in the headset microphone is made thin (has a small inner diameter) not to draw much attention. A thick cable, which is difficult to pass through the flexible pipe, is connected to the thin cable at or around the inlet of the flexible pipe.

Condenser microphones, which are typically used as microphone units in headset microphones, suffer from audible noise caused by RF current flowing through impedance converters in the condenser microphones. To prevent such noise, the audio signal wires in the microphone are protected (shielded) from static damage. Unfortunately, the junction between the thick and thin cables at or around the inlet of the flexible pipe cannot be adequately shielded.

For example, Japanese Unexamined Patent Application Publication No. 2006-033216 (hereinafter referred to as "the patent literature") discloses a condenser microphone in which the inner surface of a metal pipe is in contact with an exposed shield-covered cable in the pipe for the microphone. The shield-covered cable in the technique in the patent literature is a braided cable consisting of core wires and a copper braid therearound.

Even in the technique in the patent literature, a cable cannot be passed through a pipe with a small inner diameter and adequate shielding is not achieved due to a gap between the inner wall of the pipe and the low-density shielded wire.

SUMMARY OF INVENTION

Technical Problem

An object of the present invention is to provide a microphone device with improved shielding in and around the support.

Solution to Problem

The present invention includes a tubular support of a conductive material, a microphone unit that has a signal output terminal and is provided at and grounded to one end of the support, and a cable passing through the support. The cable includes core wires connected to the signal output terminal of the microphone unit, and a conductive coat that covers the core wires and is electrically connected to the support.

Advantageous Effects of Invention

The present invention improves shielding in and around the support.

DESCRIPTION OF EMBODIMENTS

Now will be described an embodiment of a microphone device of the present invention with reference to the attached drawings.

Figure 1:
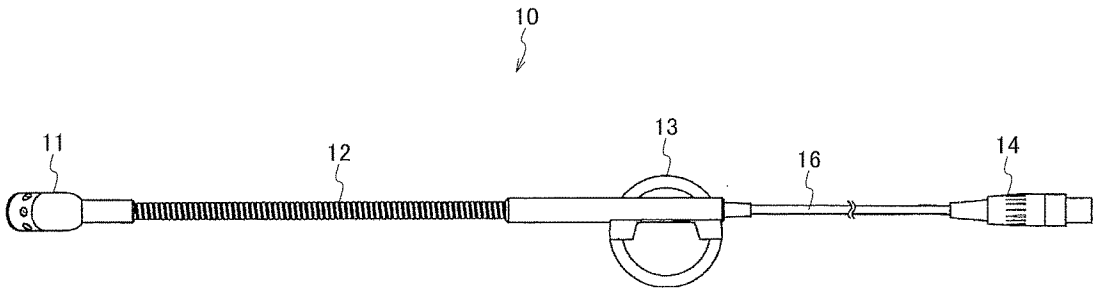
FIG. 1 is a side view illustrating an embodiment of a microphone device of the present invention.

As shown in FIG. 1, a microphone device 10 of this embodiment is a headset microphone which is mounted on the speaker's head. The microphone device 10 includes a microphone case 11 accommodating a microphone unit 15 to be described below and a flexible pipe 12 supporting the microphone case 11. The microphone device 10 further includes a pad 13 to be in contact with the speaker's head and a connector 14 to connect the microphone device 10 to an external apparatus.

Figure 2:
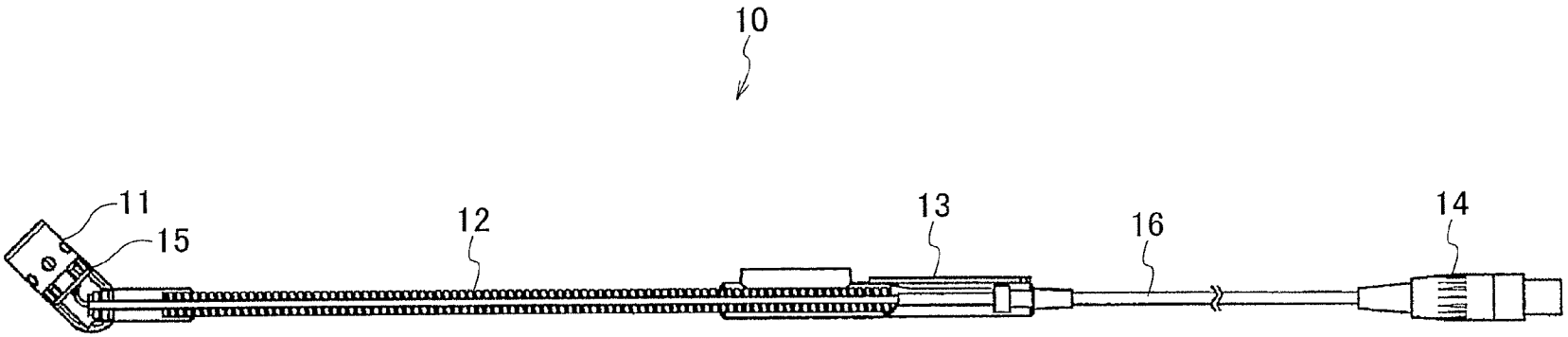
FIG. 2 is a partial cross-sectional view of the microphone device in FIG. 1.
Figure 3:
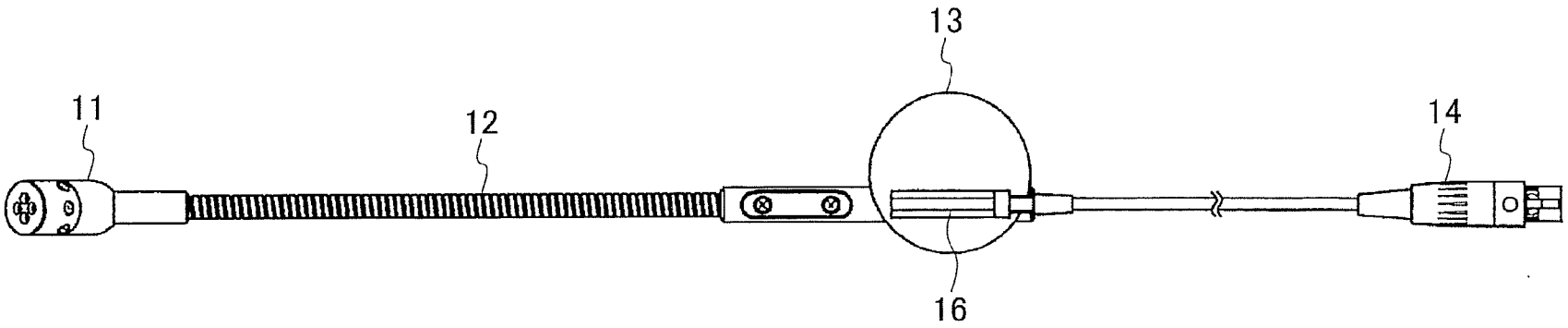
FIG. 3 is a partial cross-sectional view of the microphone device in FIG. 1.

Referring to FIGS. 2 and 3, the microphone case 11 is a substantially cylindrical case provided at one end of the flexible pipe 12. The microphone case 11 can accommodate the microphone unit 15. The microphone case 11 has openings to admit external voice.

The microphone unit 15 includes a diaphragm, a back plate, and a circuit to operate the microphone device. The microphone unit 15 is generally a compact lightweight condenser microphone. The condenser microphone includes an impedance converter. A capacitor in the condenser microphone, which is composed of the diaphragm and the back plate, has a low capacitance. The condenser microphone thus includes, for example, a field effect transistor (FET) with high input impedance as the impedance converter. The microphone unit 15 is grounded to the flexible pipe 12.

The flexible pipe 12, one example of the support, has the microphone case 11 at one end and the pad 13 at the other end. A typical headset microphone or goose-neck microphone includes the flexible pipe 12 which allows the microphone unit 15 to be moved to and fixed in an appropriate position to the speaker's mouth. The flexible pipe 12 is a hollow cylinder with a cable 16 passing therethrough. The cable 16 has the microphone unit 15 at one end and the connector 14 at the other end and electrically connects these components to each other.

The pad 13 is a base supporting the microphone case 11 and the flexible pipe 12. The pad 13 includes a hollow-cylindrical segment with the cable 16 passing therethrough and a holding segment to come into contact with the speaker's head to fix the position of the microphone unit 15.

Structures of Cable and Flexible Pipe

The structures of the cable 16 and the flexible pipe 12 in the microphone device 10 will now be described.

Figure 4:
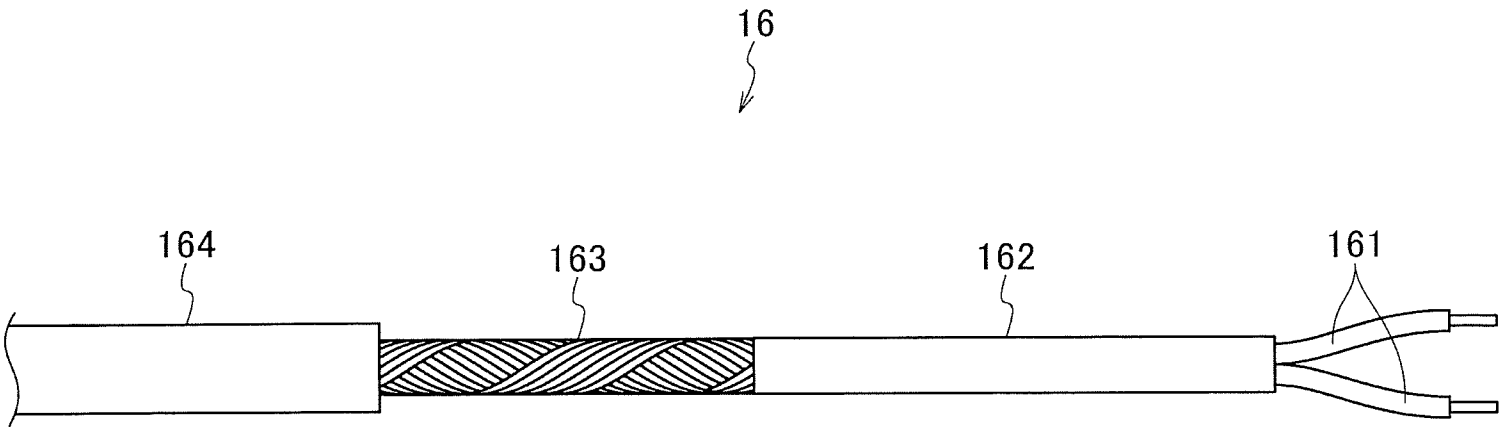
FIG. 4 is a schematic view of a cable in the microphone device in FIG. 1.

As shown in FIG. 4, the cable 16 includes core wires 161 connected to the signal output terminal of the microphone unit 15 and a conductive covering material 162 covering the core wires 161. The cable 16 further includes a shielding braid 163 covering the conductive covering material 162 and an insulating covering material 164 covering the shielding braid 163. The conductive covering material 162 directly covers the core wires 161 without a sealant or any other material therebetween. The conductive covering material 162 has an outer surface electrically connected to the inner surface of the flexible pipe 12.

A typical cable has a capacitor storing electric charge between each core wire and shielding braid. The capacitance of the capacitor varies in response to the stress applied to the cable. The cable 16 thus causes microphonic noise.

To reduce the noise caused by variations in the capacitance in the cable 16 of the microphone device 10, the cable 16 includes the conductive covering material 162 (conductive tube) that is disposed between the shielding braid 163 and each core wire 161 and is composed of a resin, such as polyvinyl chloride (PVC) containing conductive particles, such as carbon black. The resistivity of the conductive covering material 162 is approximately $10\text{-}10^7$ Ω·cm.

Figure 5:
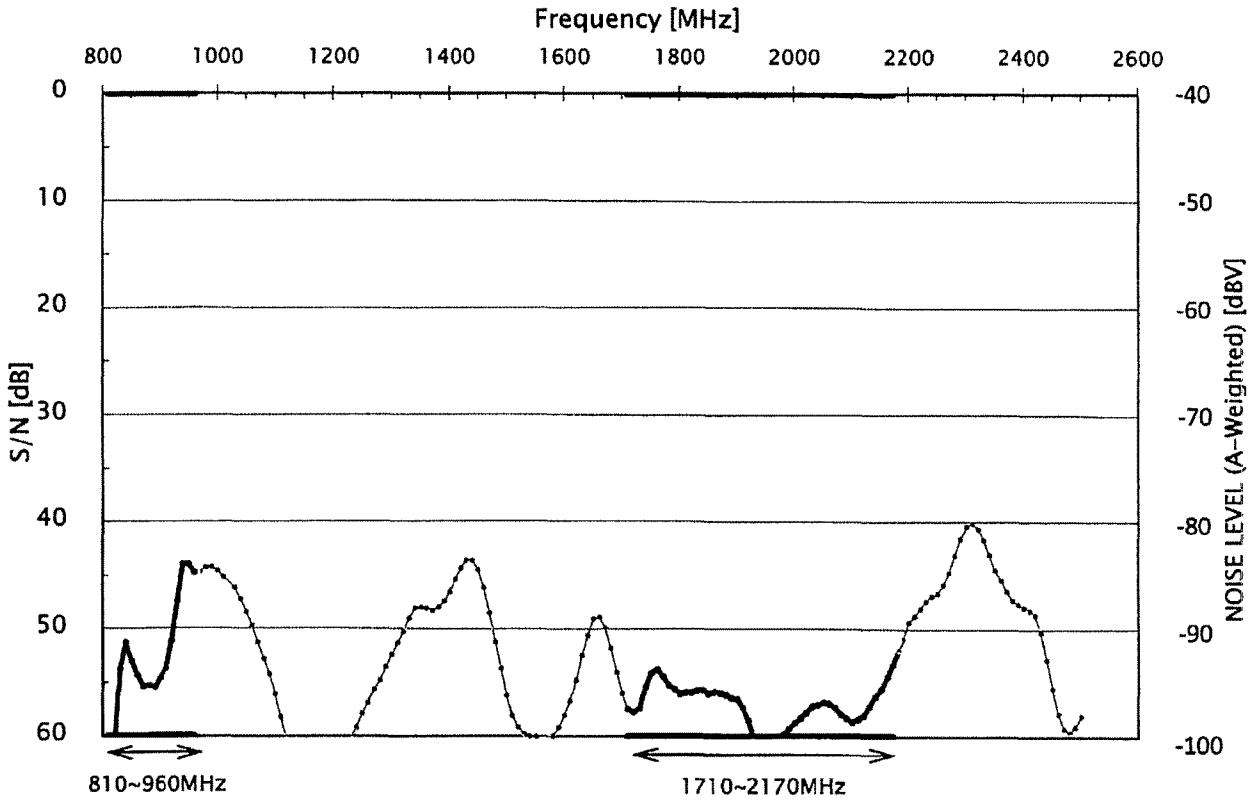
FIG. 5 is a graph showing the noise spectrum of the cable in FIG. 4.
Figure 6:
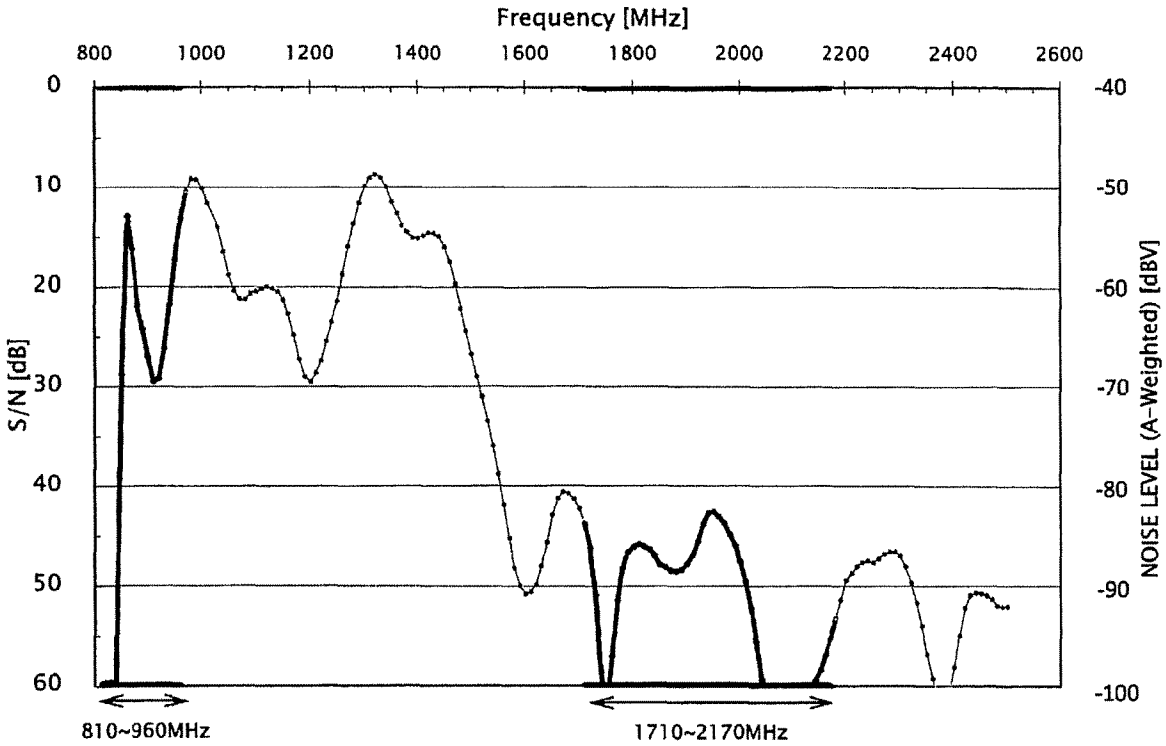
FIG.6 (Related Art)
FIG. 6 is a graph showing the noise spectrum of a cable of the related art.

Comparison between the noise spectrum of the cable 16 in FIG. 5 and that of a cable of the related art in FIG. 6 demonstrates that the noise level of the cable 16 is much lower than that of the cable of the related art over the estimated noise frequency range on the whole.

Figure 7:
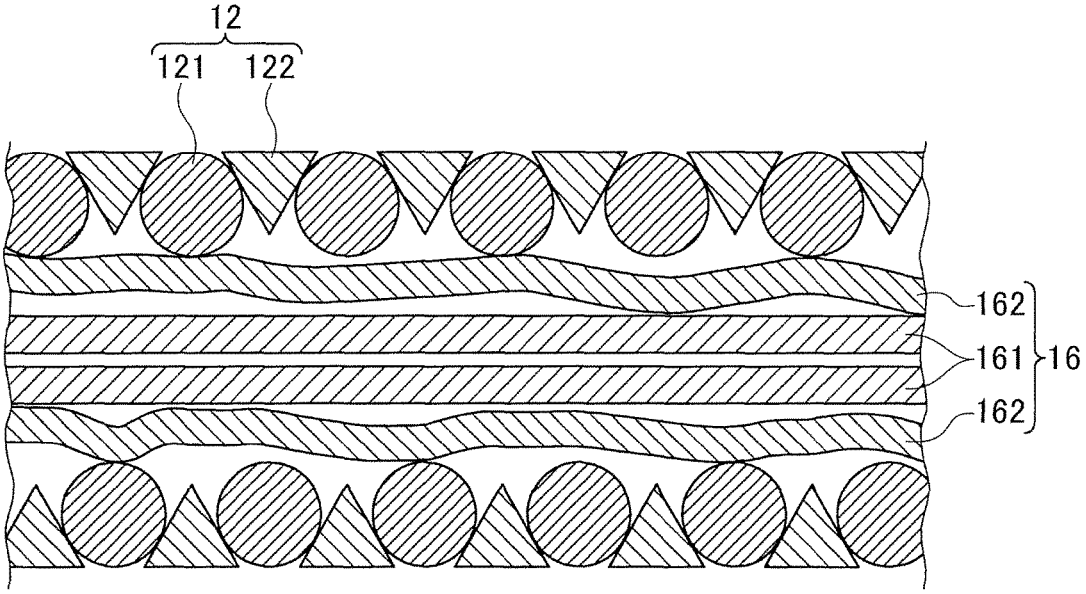
FIG. 7 is a partial enlarged cross-sectional view of the cable in the support of the microphone device in FIG. 1.

As shown in FIG. 7, the flexible pipe 12 is composed of a first wire rod 121 and a second wire rod 122 inserted in the space in the first wire rod 121. The first wire rod 121 is a coil spring of a steel wire or any other wire with a circular section. The second wire rod 122 is a coil spring of a brass wire or any other wire with a triangular section. The friction between the first wire rod 121 and the second wire rod 122 both made of a flexible plastic conductive material enables the flexible pipe 12 to be deformable while keeping its basic tubular shape. The flexible pipe 12 in the headset microphone is made thin (has a small inner diameter) not to draw much attention.

The shielding braid 163 and the insulating covering material 164 are removed from the cable 16 in the flexible pipe 12. The shielding braid 163 and the insulating covering material 164 are removed from the cable 16 and the remaining core wires 161 and conductive covering material 162 are passed through the flexible pipe 12.

The flexible pipe 12 has such an inner diameter that the cable 16 can pass therethrough while the conductive covering material 162 around the core wires 161 is in contact with the inner wall of the flexible pipe 12. In the flexible pipe 12, the conductive covering material 162 around the core wires 161 is in continuous or intermittent contact with the inner wall of the flexible pipe 12.

Figure 8:
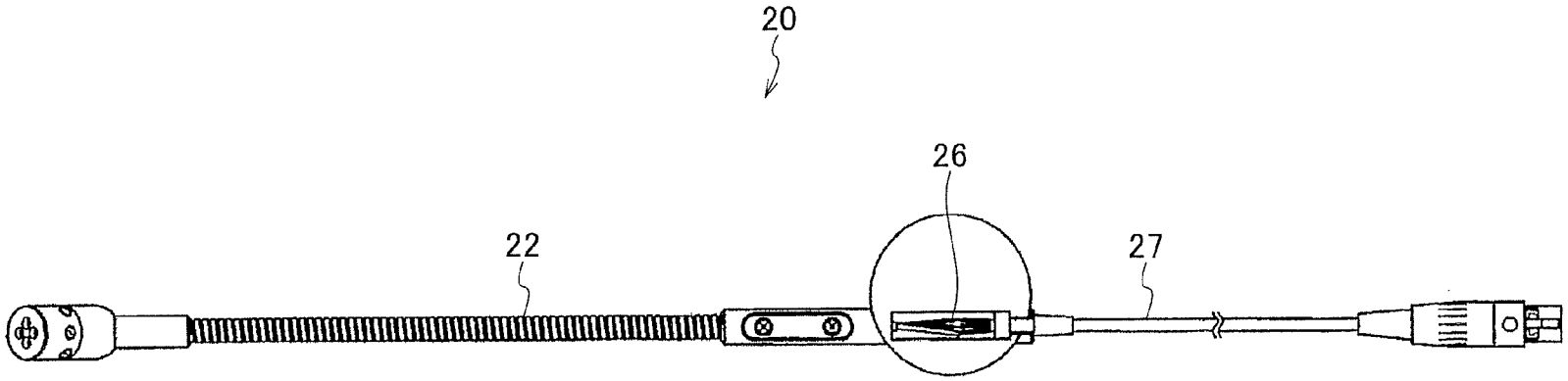
FIG.8 (Related Art)
FIG. 8 is a partial cross-sectional view of a microphone device of the related art.

In a headset microphone, a cable should be thin to pass through a flexible pipe. For this reason, as in the related art in FIG. 8, a conventional microphone device 20 has a cable 26 in the flexible pipe 22 and a cable 27 outside the flexible pipe 22, which cables are connected to each other at or around the opening of the flexible pipe 22. The cable 26 has a smaller outer diameter than the cable 27. Since the headset microphone includes many resin components, adequate shielding from static damage is not achieved at the junction between the cable 26 in the pipe and the cable 27 out of the pipe.

In the microphone device 10 of this embodiment, as described above, the core wires 161 and the conductive covering material 162 are passed through the flexible pipe 12 and the conductive covering material 162 is electrically connected to the inner wall of the flexible pipe 12. Thus, in the microphone device 10, the resistance generated between the flexible pipe 12 and the conductive covering material 162 consumes the electric power from the RF current induced in the flexible pipe 12 by intense RF waves, thereby reducing noise.

In addition, the shielding braid 163 in the microphone device 10 is electrically connected to around the opening of the flexible pipe 12, improving the shielding of the microphone device 10.

Figure 9:
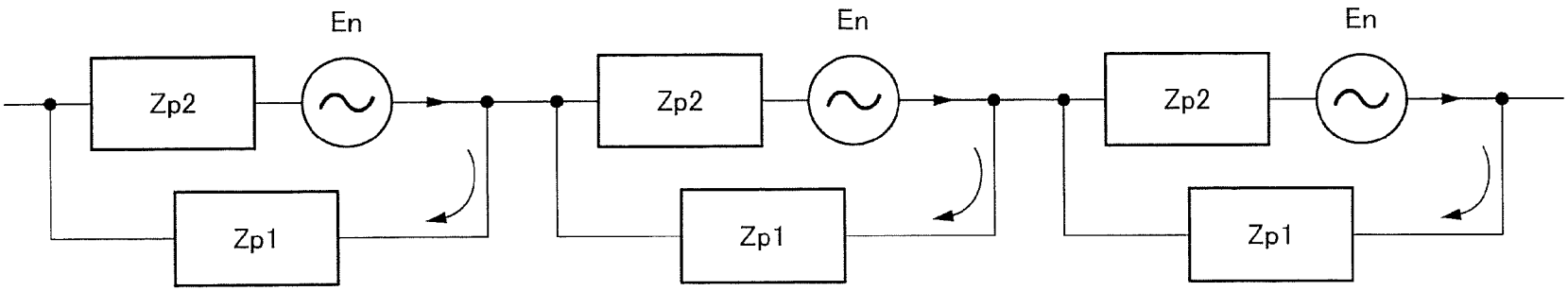
FIG. 9 is the equivalent circuit diagram of the support and the cable of the microphone device in FIG. 1.

With reference to FIG. 9, will be explained how the resistance generated between the flexible pipe 12 and the conductive covering material 162 consumes the electric power from the RF current. In the drawing, the RF current is supposed to be generated from the power supply En. In the microphone device 10, the conductive covering material 162 and the flexible pipe 12 are electrically connected at multiple points, and every pair of connection points constitutes a loop circuit. In this circuit, the RF current is attenuated by impedance Zp1 from the resistance of the conductive covering material 162 and impedance Zp2 from the resistance of the flexible pipe 12.

Figure 10:
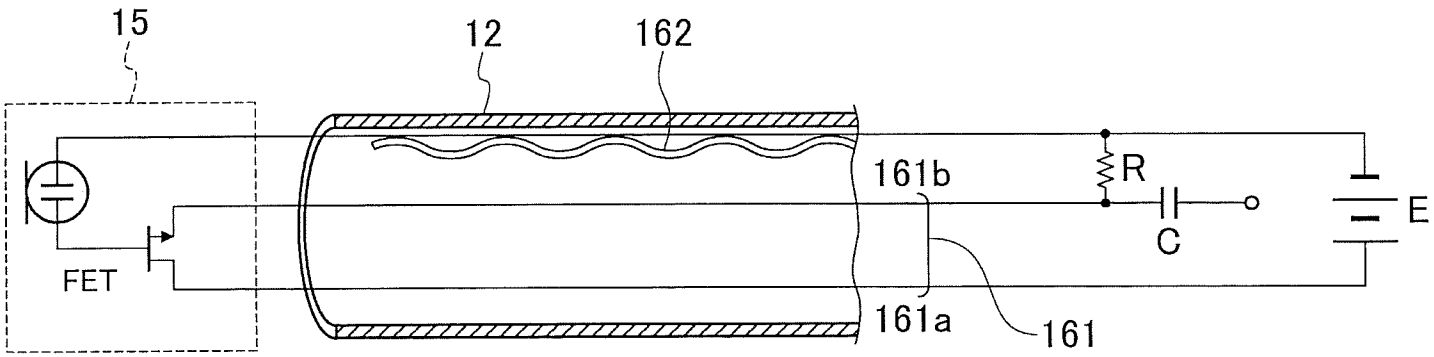
FIG. 10 is a diagram of an example audio signal circuit in the microphone device in FIG. 1.

FIG. 10 is a diagram of an example audio signal circuit in the microphone device 10. As shown in the drawing, direct current E is supplied to the microphone unit 15 including an electroacoustic transducer and the impedance converter, through a power supply line 161*a* of the core wires 161, in the microphone device 10. An FET constituting the impedance converter has a source connected to a capacitor C through a signal line 161*b*, and a drain connected to one terminal of a power supply E. The ground pattern of a circuit substrate contained in the microphone unit 15 is connected to the conductive covering material 162 and the flexible pipe 12 for connection to the other terminal of the power supply E. Such connection constitutes a part of the audio signal circuit that contains the microphone unit 15.

Figure 11:
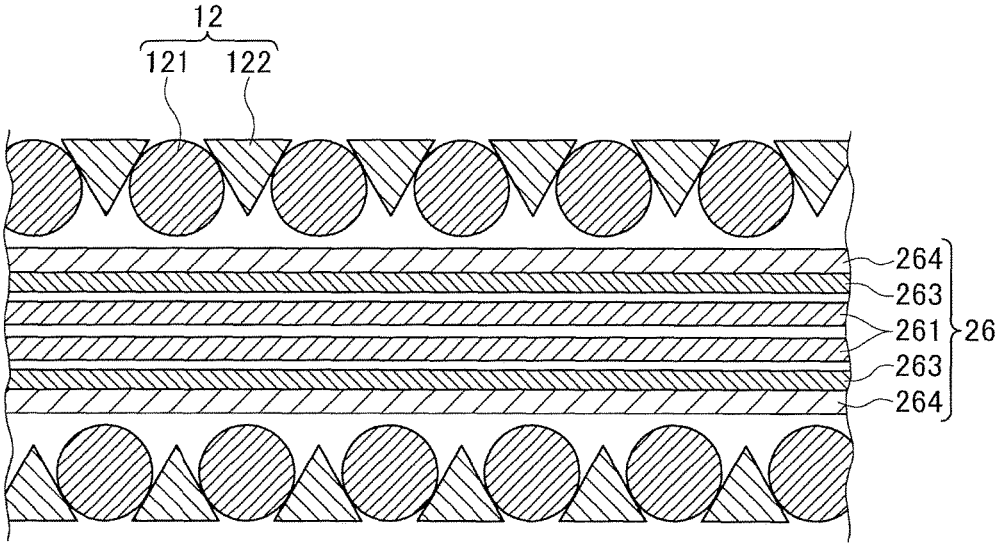
FIG.11 (Related Art)
FIG. 11 is a partial enlarged cross-sectional view of a cable in a support of a microphone device of the related art.
Figure 12:
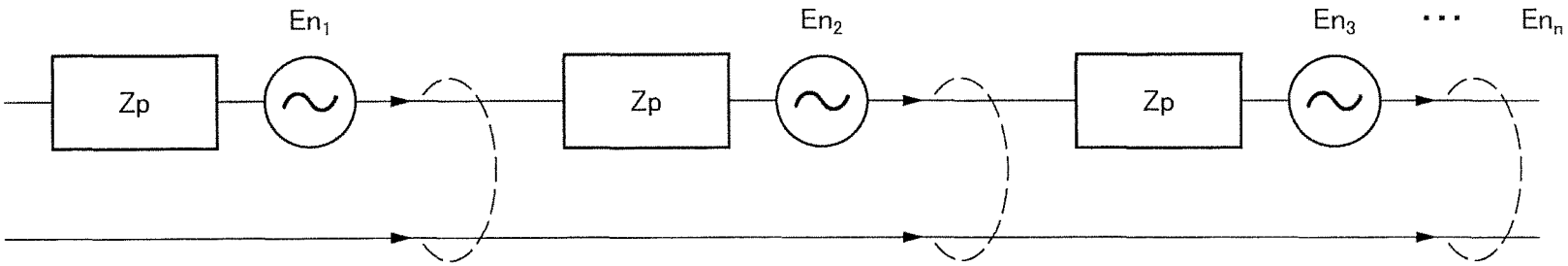
FIG.12 (Related Art)
FIG. 12 is an equivalent circuit diagram of a support and a cable of a microphone device of the related art.

In a microphone device of the related art illustrated in FIG. 11, core wires 261 in a cable, a shielding braid 263 around the core wires 261, an insulating covering material 264 around the shielding braid 263 are passed through the flexible pipe 22. As shown in FIG. 12, such a microphone device of the related art includes a plurality of circuits, each composed of impedance Zp from the resistance of the cable 26 and a power supply En generating RF current, which are sequentially connected in series. Hence, RF current in the microphone device of the related art is not attenuated but accumulated to increase the noise level.

Advantageous Effects of Embodiment

As explained above, the microphone device of this embodiment provides the following advantageous effects.

In the microphone device 10, the resistance of the conductive covering material 162 attenuates RF current, thereby reducing the noise in the audio signals.

Although a headset microphone requires a mechanically strong cable that is not broken even by the strenuous movement of the speaker, the microphone device of the related art may be subjected to a wire break or intrusion of water at the junction.

In contrast, the microphone device 10 of this embodiment does not include any junction of the cable 16 inside or outside the flexible pipe 12 as described above, improving the mechanical strength and water impermeability of the cable 16.

The flexible pipe used as a support in the embodiment may be replaced with an inflexible or rigid pipe.

The invention claimed is:

1. A microphone device comprising:

a tubular support of a conductive material wherein the tubular support has a first and a second end;

a microphone unit having a signal output terminal, the microphone unit being disposed at a first end of the tubular support and grounded to the tubular support; and a cable passing having a first portion through the tubular support to the microphone unit and a second portion extending from the second end of the tubular support, the cable comprising:

core wires connected to the signal output terminal of the microphone unit;

a conductive covering material covering the core wires;

a shielding braid covering the conductive covering material at the second portion of the cable;

an insulation material covering the shielding braid at the second portion of the cable;

wherein the conductive covering material is electrically connected to the tubular support at the first portion of the cable, wherein the conductive covering material directly covers the core wires without any other material therebetween.

2. The microphone device of claim 1, wherein the covering material is in intermittent contact with the inner wall of the support.

3. The microphone device of claim 1, wherein the covering material is in continuous contact with the inner wall of the support.

4. The microphone device of claim 1, wherein the support is a flexible pipe.

5. The microphone device of claim 1, wherein the tubular support and the conductive covering material are electrically connected to each other to constitute a circuit configured to consume the electric power from RF current induced in the tubular support.

6. The microphone device of claim 1, further comprising a base at the other end of the support, the base supporting the microphone unit and the support.

7. The microphone device of claim 1, wherein the conductive covering material is composed of a resin containing conductive particles.

8. The microphone device of claim 7, wherein the resin is polyvinyl chloride (PVC) and the conductive particles are carbon black.

* * * * *